US007100230B2

(12) United States Patent
Hillenbrand

(10) Patent No.: US 7,100,230 B2
(45) Date of Patent: Sep. 5, 2006

(54) GOLF ACCESSORY TOOL

(75) Inventor: Stephen Hillenbrand, 937 Autumn Oak Cir., Concord, CA (US) 94521

(73) Assignee: Stephen Hillenbrand, Concord, CA (US)

( * ) Notice: Subject to any disclaimer, the term of this patent is extended or adjusted under 35 U.S.C. 154(b) by 0 days.

(21) Appl. No.: 10/894,177

(22) Filed: Jul. 20, 2004

(65) Prior Publication Data

US 2006/0016018 A1 Jan. 26, 2006

(51) Int. Cl.
*B25F 1/00* (2006.01)
*B67B 7/00* (2006.01)

(52) U.S. Cl. ..... 7/156; 7/159

(58) Field of Classification Search ..... 7/156, 7/158, 126, 152, 159
See application file for complete search history.

(56) References Cited

U.S. PATENT DOCUMENTS 1,398,583 A * 11/1921 Bovee ..... 132/103
4,899,409 A * 2/1990 Cox, Jr. ..... 7/167
5,815,873 A * 10/1998 Jones ..... 15/106
2006/0016018 A1* 1/2006 Hillenbrand ..... 7/156

* cited by examiner

*Primary Examiner*—Lee D. Wilson

(57) ABSTRACT

A golf accessory tool with an elongate rigid handle, one end of the handle terminating in a double sided brush and a cleat cleaning pick, the other end of the handle terminating in a standard bottle and can opener. One side of the double sided brush has nylon or similar plastic bristles for cleaning the tops of golf shoes, golf balls and the like. The opposing brush has metal bristles that can dean golf shoe cleats and golf clubs. A preferred embodiment includes a centrally located cigar clipping device and a spring reel and tether assembly. The tether and spring reel is attached to a clip that can removably fasten to a golf bag or golf cart or belt.

1 Claim, 2 Drawing Sheets

GOLF ACCESSORY TOOL

CROSS REFERENCE TO RELATED APPLICATIONS

Not Applicable

STATEMENT REGARDING FEDERALLY SPONSORED RESEARCH OR DEVELOPMENT

Not Applicable

DESCRIPTION OF ATTACHED APPENDIX

Not Applicable

BACKGROUND OF THE INVENTION

This invention relates generally to the field of golfing accessories and more specifically to a multipurpose golf accessory tool.

Golf is a sport that has been practiced around the world for many years. In the process of playing golf, a person uses golf clubs to hit a golf ball, wears cleated golf shoes while on golfing on a lawn type playing field and many times smoke cigars and also become thirsty in the process of playing in the hot sun.

A number of tools or accessories have been designed and marketed to help golfers clean their clubs, balls, shoes and cleats and to help open refreshments and cut cigar tips.

Unfortunately, these tools take up valuable space in a golf bag or cart and can become easily misplaced. Additionally, the purchase of multiple tools can be quite expensive.

BRIEF SUMMARY OF THE INVENTION

The primary object of the invention is to provide a single portable tool that can removably attach to a golfers club bag or cart that includes a cleat cleaning brush, a ball and club cleaning brush, a cleat cleaning pick, a bottle opener and a cigar clipper.

Another object of the invention is to provide a golf tool that includes a tether and spring reel so a golfer can use the tool while it remains attached to a golf bag or golf cart even during use. Another object of the invention is to provide a single golf tool that takes the place of several separate tools thereby saving space and providing economic benefits.

Other objects and advantages of the present invention will become apparent from the following descriptions, taken in connection with the accompanying drawings, wherein, by way of illustration and example, an embodiment of the present invention is disclosed.

In accordance with a preferred embodiment of the invention, there is disclosed portable golf accessory tool comprising: an elongate rigid handle, one end of said handle terminating in a double sided brush and a cleat cleaning pick, the other end of said handle terminating in a standard can or bottle opener. One side of said double sided brush having nylon or similar plastic bristles for cleaning the tops of golf shoes, golf balls and the like, the opposing brush having metal bristles that can clean golf shoe cleats and golf clubs. The opposite end of the tool includes a can and bottle opening device. A cigar clipping tool is integrated into the handle portion.

BRIEF DESCRIPTION OF THE DRAWINGS

The drawings constitute a part of this specification and include exemplary embodiments to the invention, which may be embodied in various forms. It is to be understood that in some instances various aspects of the invention may be shown exaggerated or enlarged to facilitate an understanding of the invention.

DETAILED DESCRIPTION OF THE PREFERRED EMBODIMENTS

Detailed descriptions of the preferred embodiment are provided herein. It is to be understood, however, that the present invention may be embodied in various forms. Therefore, specific details disclosed herein are not to be interpreted as limiting, but rather as a basis for the claims and as a representative basis for teaching one skilled in the art to employ the present invention in virtually any appropriately detailed system, structure or manner.

Figure 1:
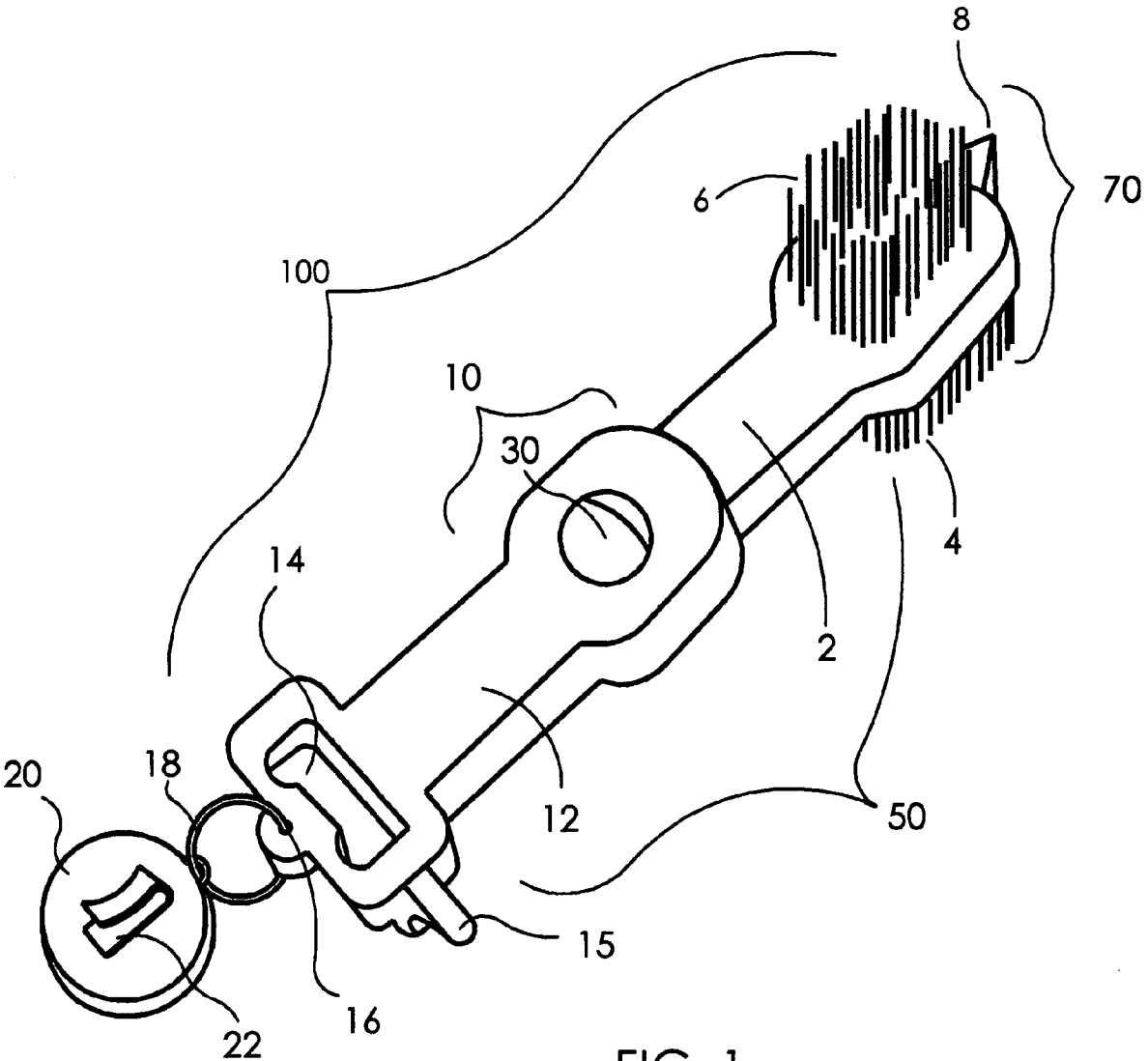
FIG. 1 is a perspective view of the invention.
Figure 2:
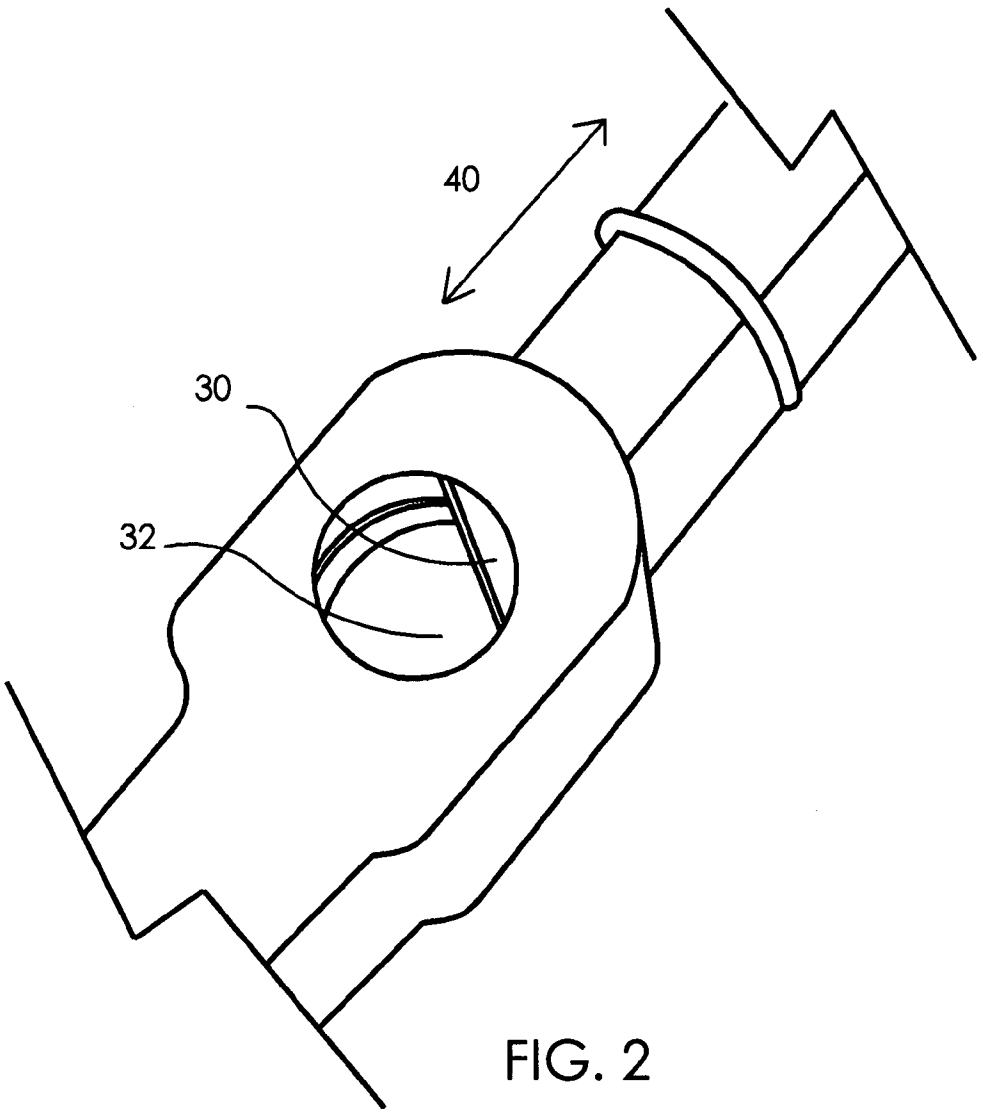
FIG. 2 is a partial perspective view showing the cigar cutting portion of the invention.

Referring now to FIG. 1 we see a perspective view of the golf accessory tool of the present invention 100. A rigid elongate handle 50 terminates at on end in a double sided brush head assembly 70 which includes a nylon ball cleaning bristle brush 6, a metal cleat cleaning and club cleaning bristle brush 4 and a cleat pick 8. The opposite end includes a standard bottle opener 14 and can opener 15. A cigar tip clipping device 10 is built into the central portion of handle 50. A tether and spring reel assembly 20 is attached to the tool 100 by a ring 18 that penetrates aperture 16. A clip 22 on spring reel 20 allows the device 100 to be clipped onto a golf bag, a golf cart or the user's pants belt. Other standard retaining means may be employed such as a spring biased clasp. FIG. 2 shows a view of the handle 50 where a portion of the handle 2 has been slid out 40 so that knife blade 30 is drawn back allowing a standard cigar to enter aperture 32 thereby allowing a person to clip the tip off of the a cigar.

In the above described and illustrated way, a golfer can conveniently perform many of the necessary cleaning and maintenance and recreational activities relating to golf playing with one convenient, easy to locate tool.

While the invention has been described in connection with a preferred embodiment, it is not intended to limit the scope of the invention to the particular form set forth, but on the contrary, it is intended to cover such alternatives, modifications, and equivalents as may be included within the spirit and scope of the invention as defined by the appended claims.

What is claimed is:

1. A golf accessory tool comprising:

an elongate rigid handle, one end of said handle terminating in a double sided brush and a cleat cleaning pick, an opposite end of said handle terminating in a standard bottle and can opening tool;

said handle constructed of a partially telescoping first and second part, wherein said first part includes a cigar sized aperture and said second part includes a cigar clipping blade so that the user can pull said first and second handle parts apart, insert a cigar tip and push said handle parts together thereby clipping the tip of said cigar;

one of said brushes having plastic bristles that can clean golf shoe cleats and golf clubs;

said cleat cleaning pick integrated into the most far end of the brush side of said elongate handle so that said cleat cleaning pick is positioned in between and parallel to said brushes.

* * * * *